US005266414A

United States Patent [19]

Goeser et al.

[11] Patent Number: 5,266,414

[45] Date of Patent: Nov. 30, 1993

[54] SOLID SOLUTION MATRIX CATHODE

[75] Inventors: Gerard A. Goeser, San Francisco; Michael C. Green, Palo Alto, both of Calif.

[73] Assignee: Varian Associates, Inc., Palo Alto, Calif.

[21] Appl. No.: 170,194

[22] Filed: Mar. 18, 1988

[51] Int. Cl.[5] ..... B22F 3/10; B22F 7/04

[52] U.S. Cl. ..... 428/545; 428/552; 428/553; 428/569; 75/232; 75/234; 75/248; 75/245; 313/346 R; 136/202

[58] Field of Search ..... 204/291, 292, 293; 75/232, 234, 245, 248; 313/346 R; 428/545, 552, 553, 569; 136/202

[56] References Cited

U.S. PATENT DOCUMENTS

| | | | |
|---|---|---|---|
| 4,097,762 | 6/1978 | Hilton et al. | 313/346 R |
| 4,165,473 | 8/1979 | Fabce | 313/346 |
| 4,393,328 | 7/1983 | Shroff et al. | 313/346 |
| 4,494,035 | 1/1985 | Palluel et al. | 313/346 |
| 4,570,099 | 2/1986 | Green | 313/346 |
| 4,675,570 | 6/1987 | Green | 313/346 |

*Primary Examiner*—Donald P. Walsh
*Assistant Examiner*—Ngoclan T. Mai
*Attorney, Agent, or Firm*—Gerald M. Fisher

[57] ABSTRACT

An impregnated thermionic cathode includes a porous matrix of sintered tungsten-alloy particles containing less than six percent iridium and/or other platinum-group metal. The pores of the matrix are impregnated with a temporary process impregnant such as molten copper or an organic monomer, and upon solidification is machined to a desired shape. Thereafter the temporary process impregnant is removed, and the matrix pores again infiltrated with a barium oxide such as molten barium aluminate, or other alkaline earth. A thin, iridium-rich surface activating layer, preferably of about 50% iridium, is then applied to the emitting surface. The diffusion of surface activating iridium is substantially blocked; superior emission and lifetime is provided; and the cathode is relatively low cost and easy to fabricate.

7 Claims, 1 Drawing Sheet

SOLID SOLUTION MATRIX CATHODE

FIELD OF THE INVENTION

The invention pertains to thermionic cathodes composed of a porous matrix of refractory metal impregnated with alkaline earth oxides of metallic constitution such as aluminates.

PRIOR ART

The basic impregnated cathode is described in U.S. Pat. No. 2,700,000 issued Jan. 18, 1955 to R. Levi. A porous body is formed by pressing tungsten powder, sintering to form a solid porous body, impregnating the pores with a liquid such as molten copper, converting the liquid to a solid as by freezing the copper, machining the impregnated cathode body to desired shape, removing the impregnant as by evaporation or chemical solution, and impregnating the body with barium aluminate. The aluminate is used instead of simple barium oxide because it can be infused in a molten state.

A further improvement is described in U.S. Pat. No. 3,373,307 issued Nov. 12, 1964 to P. Zalm, W. Sprengers, A. Johannes, A. Von Stratum, and P. van der Linden. This is a thin layer of a platinum-group metal such as osmium, iridium, ruthenium, rhenium on the emitting surface. This results in a lowered work function which permits higher emission and/or lower temperature operation. This improvement was of limited life, later found to be due to the diffusion of the activating metal to alloy with the tungsten substrate, and to sputtering it away by bombardment with positive ions formed by collisions of the accelerated emission electrons with residual gas in the electron-discharge device.

Methods of reducing the alloying and supplying more activating metal have been proposed, as by incorporating it into the tungsten matrix itself in quantities similar to that required for optimum work function. This structure has two basic disadvantages: The platinum-group metals are not as active as pure tungsten in reducing barium oxide to form the metallic barium which diffuses to the surface and activates the emission. Also, these metals are very expensive and to incorporate them in such quantities in the bulk of the cathode greatly increases the cost.

Proposals have been made to incorporate platinum-group metals only in a surface layer of the body. These have had problems with fabrication. The body shrinks during sintering so the final geometry is distorted and machining down to an affordable amount of activating metal is barely possible.

Other prior art described in U.S. Pat. No. 4,675,570 issued Jun. 23, 1987 to Michael C. Green is to include, in an iridium-alloy matrix, islands of pure tungsten, large enough to resist alloying, to provide increased reducing of barium oxide. The rest of the matrix remains a relatively poor reducing medium containing a large proportion of iridium.

Throughout this specification, a preferred embodiment of the invention is described. The materials described are only representative of the true scope, which encompasses other similar materials. The word "tungsten" shall be used to include other moderately active refractory metals and alloys, such as molybdenum. The word "iridium" includes other metals of the group consisting of platinum, osmium, rhenium and ruthenium.

The word "barium" includes other alkaline earths and mixtures, such as calcium and strontium.

SUMMARY OF THE INVENTION

An object of the invention is to provide a cathode of improved emission and life.

A further object is to provide a cathode of simple manufacture.

A further object is to provide cathodes of versatile shape made from a single standard bar stock.

A further object is to provide an improved cathode of relatively low cost.

These objects are achieved by a metallic matrix for the cathode of an alloy of tungsten with less than 6% of a platinum-group metal.

DESCRIPTION OF THE PREFERRED EMBODIMENTS

A single preferred embodiment is described. However, other similar materials may be used within the true scope of the invention. In the following description, the word "tungsten" shall encompass tungsten, molybdenum or alloys thereof. The word "iridium" shall encompass iridium, osmium, rhenium, ruthenium and alloys thereof. The word "barium" shall encompass the alkaline earths barium, strontium, calcium and mixtures thereof. The word "aluminate" shall encompass other meltable mixed oxides of the alkaline earths.

As described above, iridium-coated, tungsten matrix cathodes have had the disadvantage of short life, due in large part to removal of the iridium by diffusion into the tungsten substrate. One effort to eliminate this has been to incorporate activating platinum-group metal into the entire cathode body to remove the concentration-gradient causing the diffusion. Unfortunately, that much platinum-group metal makes the cost very high. It is only needed as a very thin layer on the emitting surface. Our research has shown that the optimum surface layer is an alloy of about 50% iridium and tungsten. Alloys in the range 40% to 60% are very good, and anything over 25% is useful.

Another suggestion has been to put between the iridium-rich emitter and the tungsten substrate an inert barrier layer which blocks diffusion into the tungsten. This has not been successfully accomplished.

Another suggestion was to incorporate iridium into a relatively thick surface layer. Due to the distortion of the matrix during its sintering process, fabrication of a uniform, thin layer is very difficult. The layer must be quite thick for practical manufacture, therefore, expensive.

Our inventive cathode contains a sufficiently small amount of iridium to be economical while still having low diffusion and hence long life.

Figure 1:
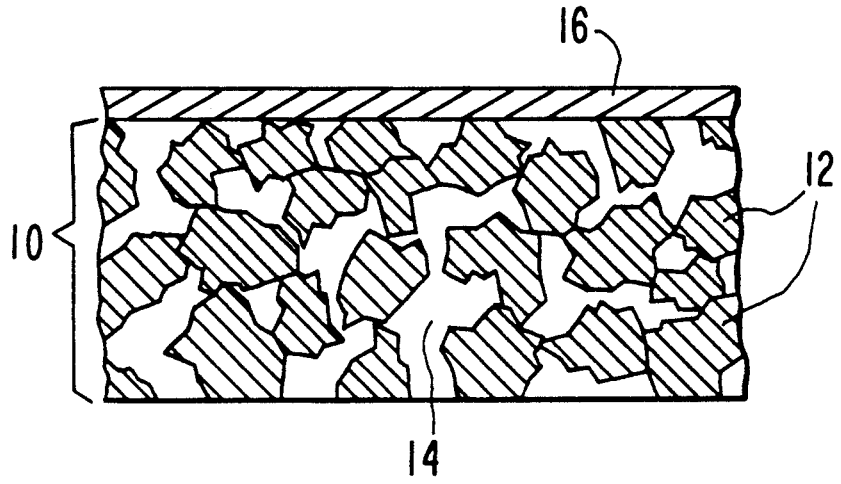
FIG. 1 is a schematic axial section of the inventive cathode.

FIG. 1 shows the finished inventive structure which is mechanically similar to prior art cathodes. The basic body 10 of the cathode is a porous matrix of tungsten alloy particles 12 containing 1.0 to 6.0% of iridium. The advantage of this composition will be explained below in connection with FIG. 2. The matrix 10 is made by the conventional process of pressing a mass of metal powders and sintering in hydrogen to alloy the tungsten and iridium, and form rigid matrix 10 with interconnecting pores 14. Pores 14 are then impregnated with a liquid process impregnant such as molten copper or an organic monomer. The impregnant is converted to a solid form by freezing the copper or polymerizing the monomer, to make a solid stock billet. Various cathode shapes are machined from the billet. The process impregnant is removed by vaporization or etching, and pores 14 are infiltrated with a molten barium oxide such as barium aluminate.

As explained above, it is known that the presence of an activating metal such as iridium on the emitting surface lowers the work function, allowing a lower operating temperature for longer life or higher thermionic emission current. Simply applying a thin layer of iridium to a pure tungsten cathode makes a good emitter, but the improvement is of short life due to alloying the iridium by diffusion into the tungsten matrix, and to sputtering away the surface layer by ion bombardment from the emitted electron stream. To add iridium to the entire matrix eliminates the diffusion, but is very expensive for the quantities previously envisioned, that is about 50% iridium which produces optimum work function. Also, such an iridium-rich alloy is not very active in reducing the barium oxide.

Figure 2:
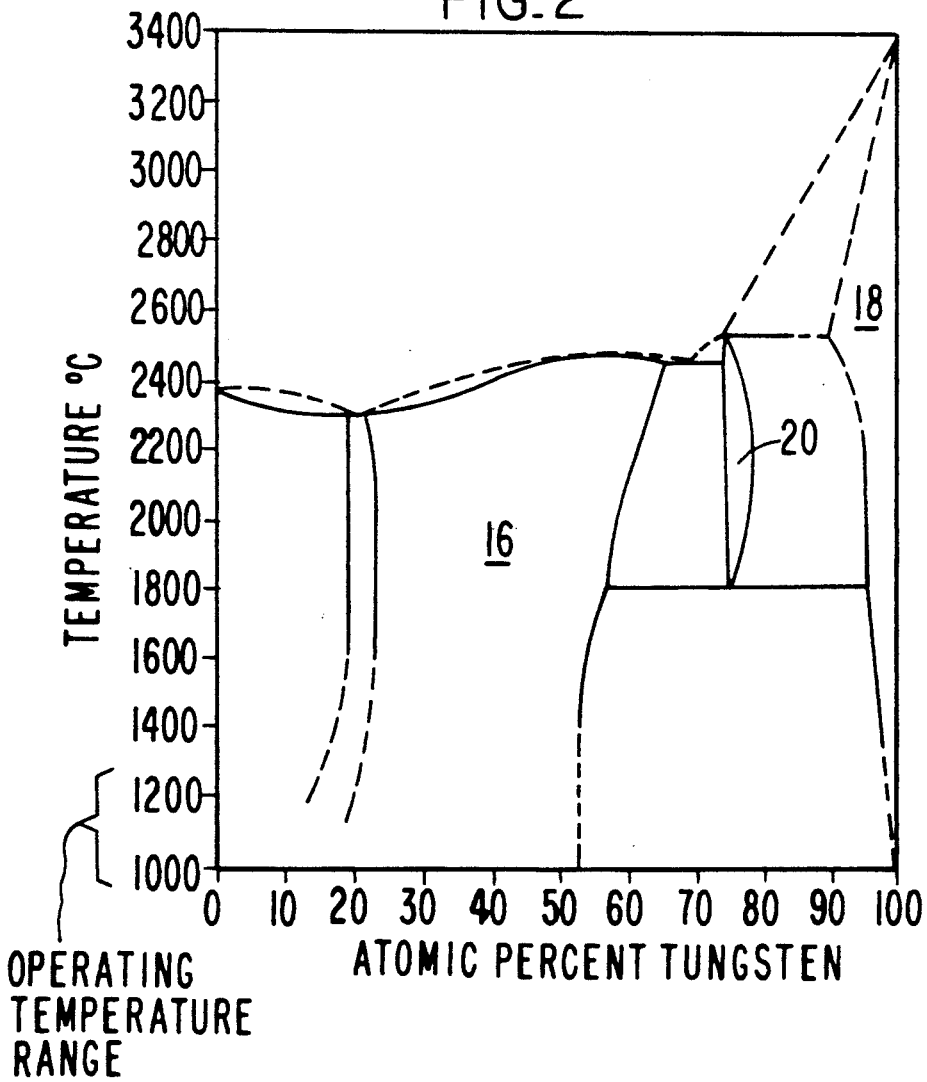
FIG. 2 is a rough sketch of the phase-diagram of tungsten-iridium alloys.

In our invention, an iridium-rich layer 16 is added only to the emitting surface. The invention is based on an investigation of the metallurgical processes and properties of tungsten-iridium alloys and of their electron emission properties. The phase diagram sketch of FIG. 2 illustrating the metallurgy is shown to clarify understanding the invention. From our electronic measurements, we have found that the lowest work function of an allow surface activated with barium and/or barium oxide is obtained with about a 50% alloy which at operating temperature of about 1050° C. will be in the phase 16 mixture of intermetallic compounds. The maximum equilibrium solubility of iridium in the tungsten body-centered cubic lattice 18 is somewhere in the 1% to 6% range. Any diffusion of iridium above this range would have to be by formation of intermetallic compounds 20 having a crystal structure different from tungsten lattice 18, but as FIG. 2 shows this compound does not exist at typical cathode operating temperatures, where phase 16 is in equilibrium with phase 18. If the tungsten-rich matrix 10 is made of an alloy of 6%, or even less, the diffusion of iridium from the iridium-rich surface activating layer 16 (FIG. 1) is blocked because the matrix particles 12 are already at the saturation limit of solubility of iridium in the solid solution phase. Since the diffusion loss is minimal, surface layer 16, which may be added by sputtering a tungsten-iridium alloy, need be only thick enough to withstand removal by sputtering. That is, a few microns thick. The total amount of expensive iridium in the cathode is thus economically reasonable. Accelerated diffusion experiments have shown that the loss of iridium is reduced by at least an order of magnitude.

A great economic advantage of the inventive cathode stems from the fact that the matrix billet may be manufactured in quantity and stocked. Any desired cathode shape may be formed by simple machining the stock. This is important when small lots of different cathodes must be made. Applying the active coating by sputtering is a simple process.

The above described preferred embodiment is intended to be illustrative and not limiting, because a variety of materials and processes may be employed within the true scope of the invention. The invention is to be limited only by the following claims and their legal equivalents.

It is recognized that even as little as 6% iridium may diminish the reducing power for creating barium. To increase reactivity, islands of pure tungsten may be incorporated in the matrix as described in U.S. Pat. No. 4,675,570, which is incorporated in this specification. This also reduces the quantity of iridium.

We claim:

1. An impregnated thermionic cathode comprising:

a porous matrix of an alloy of a refractory metal of the class consisting of tungsten and molybdenum, and a transition metal of the class consisting of iridium, osmium, rhenium and ruthenium, the content of transition metal being between 1.0% and 6.0%;

a meltable alkaline earth oxide filling the pores of said matrix; and a dense, metallic, emissive layer on a surface of said cathode, said layer composed of an alloy of one or more of said refractory metals and at least 25% of said transition metal.

2. The cathode of claim 1 wherein said refractory metal is tungsten.

3. The cathode of claim 1 wherein said transition metal is iridium.

4. The cathode of claim 1 wherein said emissive layer is between 0.1 and 10 microns thick.

5. The cathode of claim 1 wherein said oxide is an alkaline earth aluminate.

6. The cathode of claim 1 wherein said emissive layer contains between 40% and 60% of said transition metal.

7. The cathode of claim 1 wherein said matrix contains islands of said refractory metal larger than the inter-pore dimensions of said alloy matrix.

* * * * *